US005988687A

United States Patent [19]

Krisch

[11] Patent Number: 5,988,687

[45] Date of Patent: Nov. 23, 1999

[54] COMPUTER PRINTABLE JIGSAW PUZZLE

[76] Inventor: Robert F. Krisch, 23 Barry Dr., Glen Cove, N.Y. 11542

[21] Appl. No.: 09/048,355

[22] Filed: Mar. 26, 1998

Related U.S. Application Data

[60] Provisional application No. 60/041,677, Mar. 26, 1997.

[51] Int. Cl.[6] ..... A63F 9/06; A63F 9/08

[52] U.S. Cl. ..... 281/51; 273/288; 273/157 R; 283/903; 283/49

[58] Field of Search ..... 273/157 R, 288; 283/903, 49

[56] References Cited

U.S. PATENT DOCUMENTS 4,756,533 7/1988 Hopkins et al. ..... 273/157 R 5,622,384 4/1997 Bradley ..... 281/51

*Primary Examiner*—Willmon Fridie, Jr.
*Assistant Examiner*—Mark T. Henderson
*Attorney, Agent, or Firm*—Collard & Rue, P.C.

[57] ABSTRACT

A puzzle for printing on a printer having rollers in its paper feed path, such as a personal computer printer. The puzzle is a semirigid but flexible sheet having at least one blank side serving as means for printing on by the printer. The sheet is sufficiently flexible to negotiate through the rollers of the printer. The sheet has a plurality of die-cuts defining pieces. The die-cuts intersect at intersections. The intersections have nicks for separating each cut at its intersection, and for maintaining rigidity of the sheet during printing.

10 Claims, 2 Drawing Sheets

COMPUTER PRINTABLE JIGSAW PUZZLE

This application claims benefit of provisional application Ser. No. 60/041,677, filed Mar. 26, 1997.

FIELD OF INVENTION

The present invention relates to a jigsaw puzzle, particularly a jigsaw puzzle which is provided in blank and is capable of being printed on by a conventional computer printer such as a laser printer, or a dot matrix printer, ink-jet printer, or plain paper copier or fax.

BACKGROUND OF THE INVENTION

The inventor has long sold, through Compoz-A-Puzzle Inc., jigsaw puzzles, which have been die-cut in such a way that the puzzle pieces remain intact as a single sheet of cardboard until the puzzle is bent sufficiently to break "nicks" in the die-cut cardboard and to allow the pieces to separate. "Nicks" are uncut portions of the cardboard along the cuts. The uncuts or nicks are made by nicking blades of the cutting die that perforates the cardboard to cut the puzzle pieces.

OBJECT OF THE INVENTION

It is an object of the present invention to provide a blank sheet of cardboard of sufficient thickness to serve as a jigsaw puzzle, die-cut for separation into jigsaw puzzle pieces, yet with the pieces shaped and containing sufficient uncut portions to retain the puzzle as an intact sheet as it passes through a computer printer such as a laser printer, ink-jet printer, or dot-matrix printer; a plain paper copier; or a fax. Such printers generally have rollers in their paper feed path, which would jam on the thick cardboard of conventional puzzles.

THE INVENTION

The invention uses a cardboard of a specific and critical thickness. If the cardboard is too thick it will not run through a typical computer printer. It will cause a paper jam.

If the cardboard is too thin it will not interlock solidly as a puzzle, but will lay upon its neighbor piece like thin paper.

As the size of the cardboard sheet approaches 8½ inches in width, it becomes very helpful, and for many printers essential, that the cardboard have a grain which runs across the width of the paper, so that the strands of material, that comprise the cardboard, roll their longitudinal strand dimensions cross-wise to the paper path and parallel to the rollers, rather than attempting to stiffen the cardboard in its longitudinal direction and to resist the bend of the rollers.

The invention also utilizes specially shaped puzzle pieces which resist breaking apart, particularly since they are die-cut with nicks in the die, which nicks leave unperforated portions. of the shaped perforations. These nicks are located at each intersection of a horizontal line and a vertical line, and thereby provide structure which holds the cardboard together. Absent this structure, the cardboard jigsaw puzzle will break apart within a printer mechanism as it traverses the rollers, and pieces would get caught inside the printer and cause a paper jam.

Further nicks are made at the vertical apexes of the puzzle pieces.

DETAILED DESCRIPTION OF THE DRAWINGS

Figure 1:
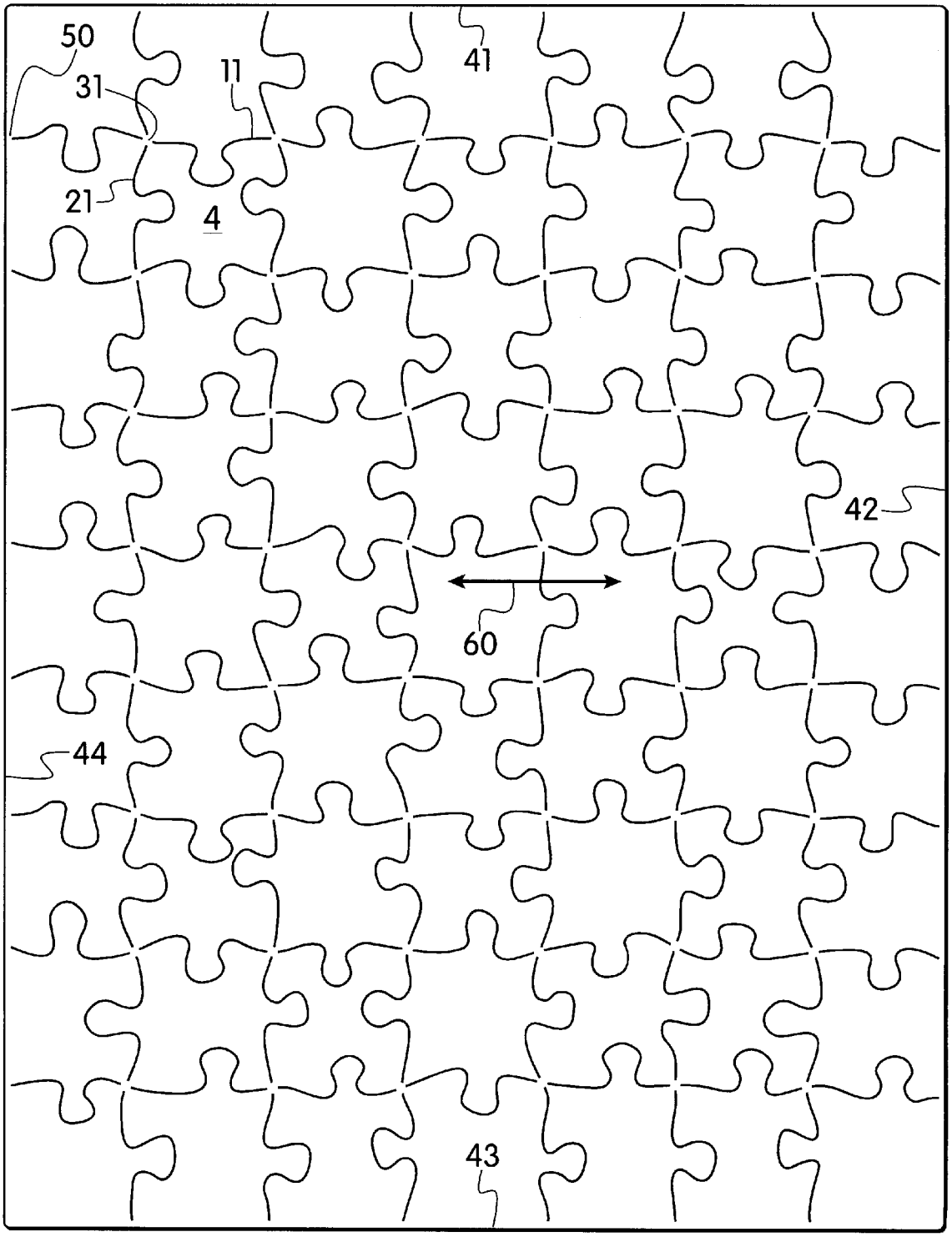
FIG. 1 is a plan view of a die-cut sheet showing the die-cuts in black lines.

FIG. 1 shows a sheet of cardboard, which is used as a printing blank for the present invention. The sheet has a critical thickness of about 0.010 inches. If the thickness of the cardboard is as little as 0.008 inches, the puzzle will be too thin and will not have an appropriate feel or interlock characteristic to satisfy most jigsaw puzzlers. If the cardboard thickness ranges above 0.012 inches, the cardboard is likely to be too stiff to pass through all but the most robust computer printer paper feed systems.

It will be understood that professional printing presses and photocopy machines can also be employed to print upon the present invention. Dot matrix printers and ink-jet printers with color capabilities can be employed as inexpensive means for printing colored pictures or text upon the puzzles.

Each puzzle piece 4, is uniquely defined by convoluted lines, such as horizontal line 11 and vertical line 21. These lines have been cut by a die-cut apparatus. Unlike many conventional jigsaw puzzles, the puzzles of the present invention are sold intact, so that they can be printed on a laser printer or other computer printer. To maintain the pieces intact, nicks are made at each intersection of crossing steel blades in the die. This expresses itself on the cardboard, as an unperforated break in the cut lines, such as the nick at intersection 31 of lines 21 and 11.

Nicks are also made at borders 41–44, wherever a line such as 11 intersects a border, such as 44 as at intersection 50.

The direction of the grain of the cardboard is represented by arrow 60, in order to make the cardboard as flexible across the rollers of a computer printer as is possible for a given rigidity of the puzzle material.

Figure 2:
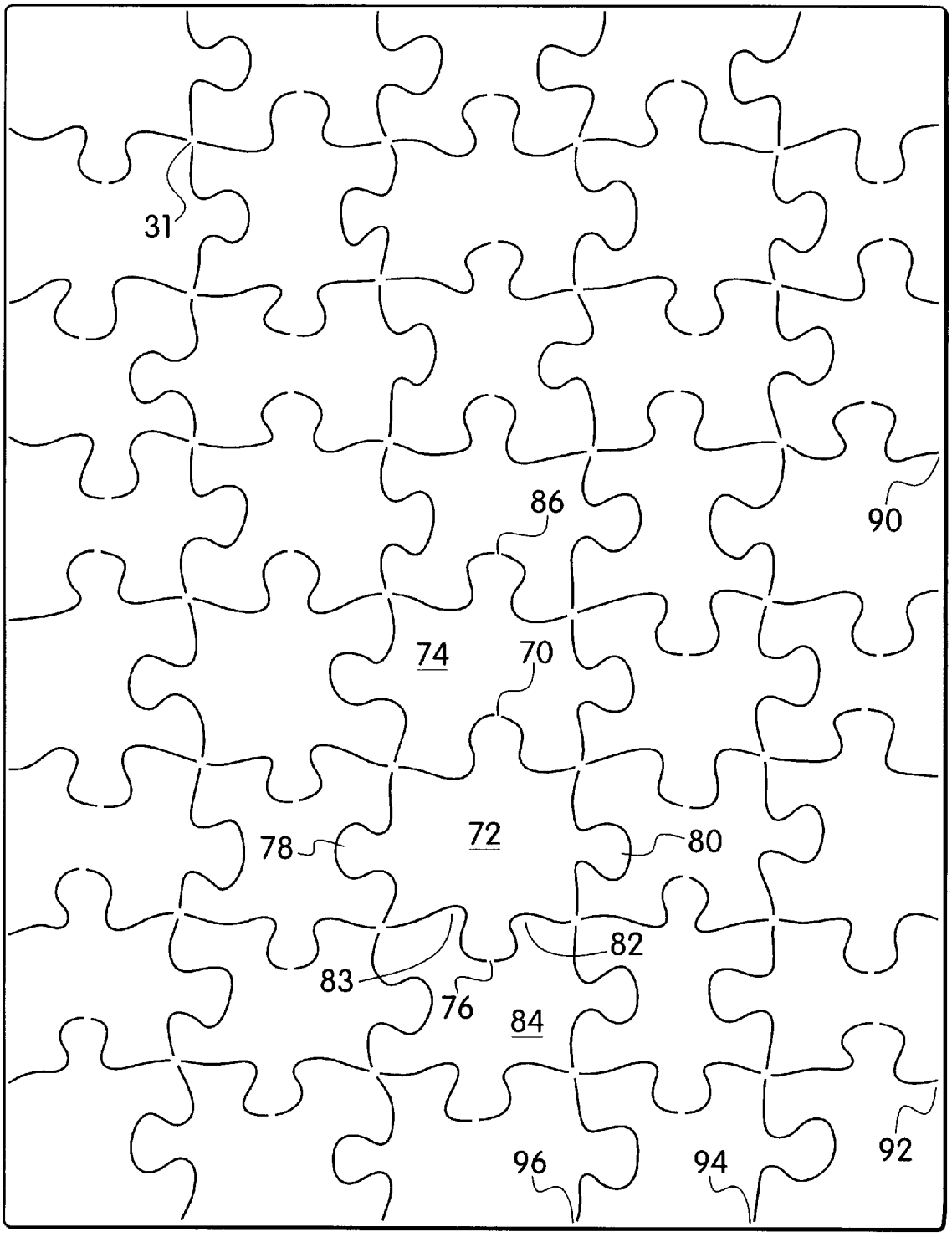
FIG. 2 is a plan view of a die-cut sheet showing the die-cuts in black lines.

FIG. 2 shows a further improvement in the die cutting of the puzzle pieces. In addition to the nicks 31 at each intersection, an additional nick 70 is placed at the apex of each piece 72. We will define an apex to be at a farthest point from the center of each piece, in a longitudinal direction of the paper. For example, piece 72 has a second apex at 76. Piece 72's protrusions at 78 and 80 need not be nicked because they are on the horizontal axis, and do not tend to pull apart as they go through the printer rollers. Similarly, bulge 82 of piece 84 need not be nicked because nick 76 at the apex of piece 72 provides sufficient integrity to prevent the puzzle from popping apart in printing. Piece 74 has only a single apex at nick 86. Its second nick on the vertical axis is at apex 70 of piece 72.

It will be understood that a less preferable alternative to an apex nick at 76 would be bulge nicks at 82 and 83 of piece 84. Both bulges and apexes may be nicked, but at a cost of some ease of breaking apart the pieces.

The border of the puzzle contains peripheral nicks such as 90, 92, 94 and 96, at each intersection of each die-cut with a sheet edge.

Having thus described my invention I claim:

1. A puzzle for printing on a printer having rollers in a curving feed path, said puzzle comprising:

a semirigid but flexible sheet;

said sheet having at least one side having an area suitable for printing on by the printer;

said sheet having sufficient flexibility to negotiate through the printer;

said sheet having a plurality of die-cuts;

said die-cuts defining a plurality of pieces;

said die-cuts having nick means for maintaining rigidity of the sheet during printing.

2. A puzzle according to claim 1 in which the sheet has greater stiffness in a direction of its width than in its longitudinal direction.

3. A puzzle according claim 1 further comprising:

said pieces having centers;

a plurality of apexes:

each apex defined as a farthest dimension in a vertical direction from the center of a piece; and nick means substantially at said apexes for maintaining structural integrity of the sheet during printing.

4. A puzzle according to claim 1 having a plurality of intersections of die-cuts with a periphery of the puzzle;

each said peripheral intersection having nick means for separating the die-cut from the periphery and for thereby maintaining structural integrity of the puzzle during printing.

5. A puzzle according claim 1 in which the sheet is cardboard, and has a thickness in a range of 0.008 to 0.012 inches.

6. A puzzle according to claim 5, in which the cardboard has an optimal thickness of 0.010 inches.

7. A puzzle according to claim 1 having nicks at vertical bulges of the pieces.

8. A puzzle according to claim 1 in which the side is blank.

9. A puzzle according to claim 1 in which:

said die-cuts intersect at a plurality of intersections;

at least one intersection of the plurality has nick means for separating each cut at its intersection, and for maintaining rigidity of the sheet during printing.

10. A puzzle for printing on a printer having rollers in a curving feed path, said puzzle comprising:

a semirigid but flexible sheet;

said sheet having sufficient flexibility to negotiate through the printer;

the sheet having greater stiffness across its width than in its longitudinal direction;

said sheet having a plurality of die-cuts;

said die-cuts defining a plurality of pieces;

said die-cuts being punctuated by nick means for maintaining the rigidity of the sheet during printing;

said sheet having at least one blank side suitable for printing by computer printer;

said die-cuts intersecting at a plurality of intersections;

at least one intersection of the plurality having nick means for separating each cut at its intersection;

further comprising a plurality of apexes, each apex defined as a farthest vertical dimension from the center of the piece;

each apex having a nick means for maintaining structural integrity of the sheet during printing;

having plurality of intersections of die-cuts with a periphery of the puzzle;

each said peripheral intersection having nick means for maintaining the structural integrity of the puzzle;

in which the cardboard has an optimal thickness of 0.010 inches.

* * * * *